US009057262B2

(12) United States Patent
Kolle

(10) Patent No.: US 9,057,262 B2
(45) Date of Patent: Jun. 16, 2015

(54) HYPER-PRESSURE PULSE EXCAVATOR

(71) Applicant: Tempress Technologies, Inc., Kent, WA (US)

(72) Inventor: Jack J. Kolle, Seattle, WA (US)

(73) Assignee: Tempress Technologies, Inc., Kent, WA (US)

( * ) Notice: Subject to any disclaimer, the term of this patent is extended or adjusted under 35 U.S.C. 154(b) by 0 days.

(21) Appl. No.: 13/953,221

(22) Filed: Jul. 29, 2013

(65) Prior Publication Data

US 2014/0028078 A1 Jan. 30, 2014

Related U.S. Application Data

(60) Provisional application No. 61/676,744, filed on Jul. 27, 2012.

(51) Int. Cl.
*E21C 45/04* (2006.01)
*E21C 25/60* (2006.01)

(52) U.S. Cl.
CPC ..... *E21C 25/60* (2013.01); *E21C 45/04* (2013.01)

(58) Field of Classification Search
CPC ..... E21C 45/04; E21C 45/00; E21C 45/02; E21C 45/06; E21C 45/08
USPC ..... 299/17
See application file for complete search history.

(56) References Cited

U.S. PATENT DOCUMENTS

| | | | | |
|---|---|---|---|---|
| 3,572,839 | A | 3/1971 | Okabe | |
| 3,746,256 | A * | 7/1973 | Hall et al. | 239/101 |
| 4,863,101 | A * | 9/1989 | Pater et al. | 239/99 |
| 5,000,516 | A * | 3/1991 | Kolle et al. | 299/16 |
| 5,944,123 | A | 8/1999 | Johnson | |
| 6,123,394 | A * | 9/2000 | Jeffrey | 299/16 |
| 6,301,766 | B1 * | 10/2001 | Kolle | 29/421.2 |

OTHER PUBLICATIONS

International Searching Authority; Search Report and Written Opinion of the International Searching Authority; mailed Nov. 8, 2013.
Kolle, J.J.; Hydraulic pulse generator for nonexplosive excavation; Technical Papers, Mining Engineering, Jul. 1997; pp. 64-72 U.S.

* cited by examiner

*Primary Examiner* — John Kreck
(74) *Attorney, Agent, or Firm* — Morgan, Lewis & Bockius LLP

(57) ABSTRACT

A hyper-pressure water cannon, or pulse excavator, is able to discharge fluid pulses at extremely high velocities to fracture a rock face in excavation applications. A compressed water cannon can be used to generate hyper-pressure pulses by discharging the pulse into a straight nozzle section which leads to a convergent tapered nozzle. The hyper-pressure water cannon design is relatively compact, and the pulse generator can readily be maneuvered to cover the face of an excavation as part of a mobile mining system.

24 Claims, 11 Drawing Sheets

HYPER-PRESSURE PULSE EXCAVATOR

RELATED APPLICATIONS

The present application claims the benefit of U.S. Provisional Patent Application No. 61/676,774, filed on Jul. 27, 2012, which is herein incorporated by reference in its entirety.

BACKGROUND

1. Field of the Invention

The present invention relates to non-explosive mining techniques for mining operations.

2. Description of the Related Art

Non-explosive mining techniques offer an alternative to the increasing costs associated with explosive excavation. Explosive excavation is a cyclic process requiring several steps: blast holes are drilled into a rock face, explosive charges are loaded into the blast holes, the surrounding area is evacuated, the explosives are detonated, and the area is ventilated and cleared. Explosive excavation incurs significant costs associated with security and environmental damage, such as the generation of toxic gases.

Mechanized non-explosive mining may be carried out with fewer personnel and reduce the security and environmental costs of high explosives. This approach also increases processing efficiency by allowing selective mining of the ore veins. Mechanical impact hammers can be used to excavate hard rock, but the process is slow; the hammers and support equipment are very heavy and the impact tools wear out quickly.

Another example of mechanized non-explosive mining is an impact piston water cannon, in which compressed air drives a heavy piston that impacts and pushes a quantity, or slug, of water. The water slug impacts the rock face to cause erosion and excavation. While impact piston devices have been shown to generate high pressures, their use in commercial excavation work has been limited due to the significant wear on the pistons and cylinders of the devices. Further, the mechanical system that must be maneuvered at the rock face is prohibitively bulky.

As an alternative to an impact piston cannon, a compressed water cannon designed for hard rock mining is described in "A Hydraulic Pulse Generator for Non-Explosive Excavation," by Kolle, J. J., in *Mining Engineering*, July 1997, pg. 64-72, which is herein incorporated by reference in its entirety. The compressed water cannon comprises a heavy pressure vessel charged to very high pressures (100-400 MPa, or 14,500-60,000 psi). At these pressures, the water is substantially compressed and stores a considerable amount of energy. After charging, the water is discharged through a fast-opening valve, which causes the resulting pulse of water to impact the rock face. Discharge of a 100 to 400 MPa pulse onto the face of hard rock will have little or no effect in rock fragmentation. To perform rock fragmentation, the compressed water cannon nozzle must be inserted and discharged into a pre-drilled blast hole. Discharge of the pulse into the blast hole generates tensile stresses in the rock and allows effective excavation. The productivity and flexibility of this approach, called bench blasting, is limited because drilling is the most time-consuming aspect of the operation.

As reported by Mauer, W. C. in *Advanced Drilling Techniques*, pg. 302-348, Petroleum Publishing Inc., 1980, hyper-pressure pulses that are over 1 GPa, or 145,000 psi, have been shown to efficiently excavate hard rock by cratering, eliminating the need for a pre-drilled blast hole. Accordingly, it would be desirable to enable a compressed water cannon to be employed without the need for a pre-drilled blast hole.

SUMMARY OF THE INVENTION

In accordance with the present invention, the problems above are addressed with a hyper-pressure water cannon. The hyper-pressure water cannon, or pulse excavator, is able to discharge fluid pulses at extremely high velocities to fracture a rock face in excavation applications. A compressed water cannon can be used to generate hyper-pressure pulses by discharging the pulse into a straight nozzle section which leads to a convergent tapered nozzle. The water cannon design is relatively compact, and the pulse generator can readily be maneuvered to cover the face of an excavation as part of a mobile mining system. As an alternative, the pulse could be generated by a propellant gun.

Hyper-pressure pulse excavation, or cratering, is an application of the water cannon that eliminates the need for drilling a blast hole. The high-velocity water pulse is discharged into a combination straight and tapered nozzle that can amplify the peak pulse pressure by a factor of 10 or more.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

DETAILED DESCRIPTION

Figure 1A:
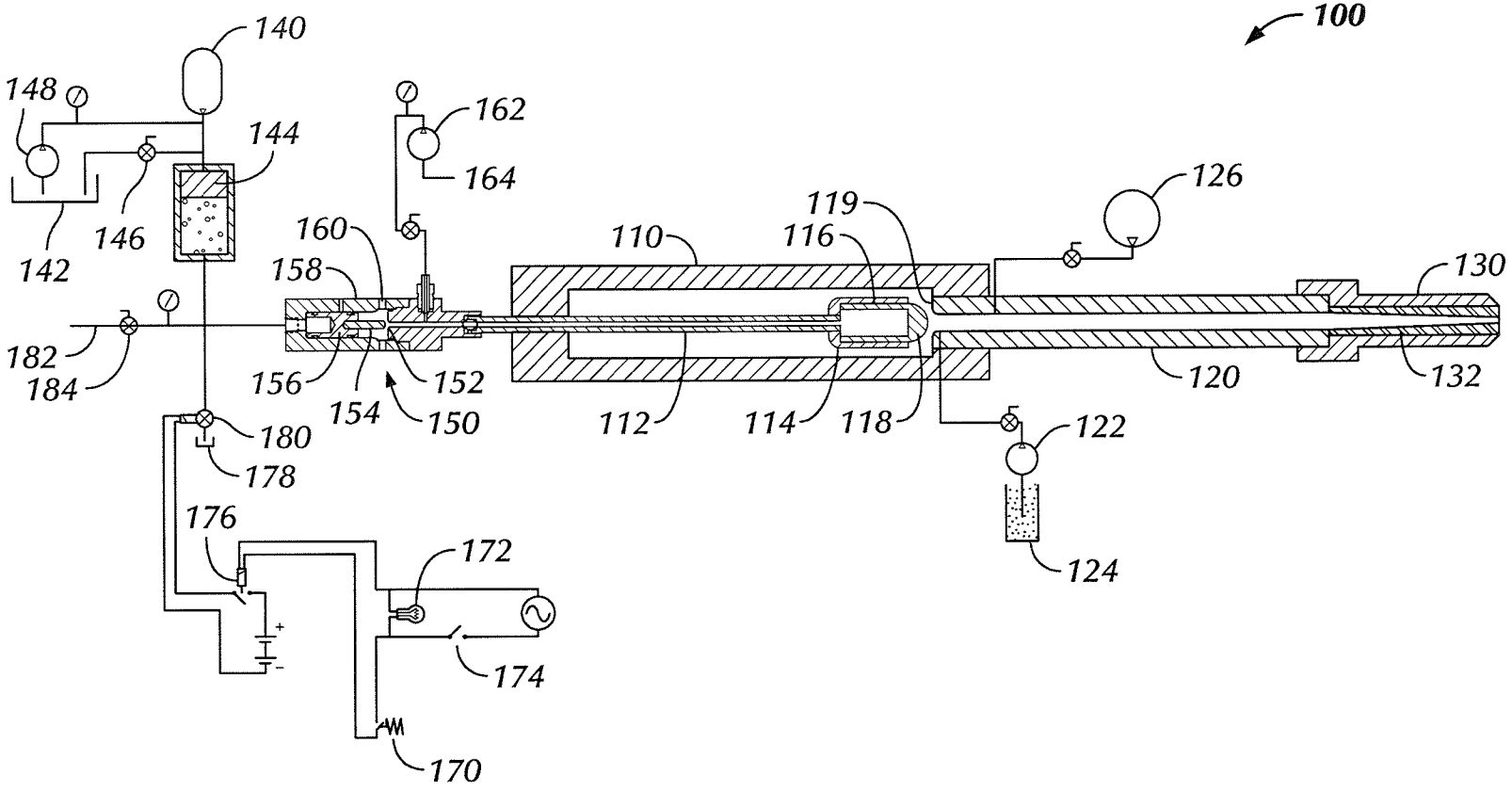
FIG. 1A illustrates a cross-sectional schematic view of a complete hyper-pressure pulse excavator 100 including an electrical trigger, vent valve assembly 150, pressure vessel 110, and two-part nozzle assembly (120 and 132)

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

FIG. 1A illustrates a schematic of an exemplary hyper-pressure pulse excavator 100, shown after firing a water pulse. The pulse excavator 100 includes a pressure vessel 110 and a two-part nozzle assembly, which includes a straight nozzle section 120 and a tapered nozzle section 132 within a nozzle housing 130. The pressure vessel 110 includes a supply tube 112, a poppet sleeve 114, a sleeve port 116, and a poppet 118. When poppet 118 is closed, it sits against poppet seat 119 at the end of pressure vessel 110. When the poppet 118 is opened, or pushed away from the poppet seat 119, the poppet 118 and poppet seat 119 together act as a dump valve, and pressurized fluid in the pressure vessel 110 is discharged into the straight nozzle section 120. The junction of the pressure vessel 110 and the straight nozzle section 120 includes an opening connected to an air compressor 126 and a second opening connected to a metering pump 122 and a gel supply 124. The electrical subsystem of the pulse excavator 100 includes a push button switch 170, arm light 172, arm switch 174, relay switch 176, and the solenoid valve 180 (including battery power for the solenoid).

Fluids within the hyper-pressure pulse excavator 100 build to extremely high pressures and must be discharged very quickly to effectively crater rock. Additionally, an excavating tool such as the pulse excavator 100 should not be so unwieldy and large as to prevent moving the tool around the rock face. Off-the-shelf valve systems offering suitable performance in both size and speed for such operation are typically not available. Instead, as shown in FIG. 1A, a series, or system, of cascading valves leading to the pressure vessel 110 can be used. Each subsequent stage the handles progressively larger volumes and pressures, and the final stage opens the poppet 118 in the pressure vessel 110. While FIG. 1A shows an exemplary series of cascading valves, different types and arrangements of valves may be used to operate the poppet 118 in the pressure vessel 110.

The series of cascading valves includes the solenoid valve 180, the hydraulic pump return valve 146, the pressurized water supply valve 184, and the vent valve assembly 150. In operation, the accumulator 140, return tank 142, and hydraulic pump 148, and isolator piston 144 serve to maintain a pressure on the vent valve assembly 150 until the solenoid valve 180 can open. In the discharged state after firing, the hydraulic pump return valve 146 is open, resulting in water pressure from pressurized water supply 182 moving the isolator piston 144 to its upper position. The hydraulic pump 148 is also shown with a return tank 142 and an accumulator 140. Additionally, the pressurized water supply valve 184 is open, and the solenoid valve 180 to the tank 178 is closed and unarmed. Additional details of the valve operation can be seen in U.S. Pat. No. 5,000,516 to Kolle, entitled "Apparatus for rapidly generating pressure pulses for demolition of rock having reduced pressure head loss and component wear," issued Mar. 19, 1991, which is incorporated herein in its entirety.

In a preferred embodiment of the invention, the pulse excavator 100 further includes a vent valve assembly 150. The vent valve assembly 150 includes a vent valve housing 158 with vent valve vents 160. Although the pressurized water supply valve 184 is open, the vent valve piston 156 in the vent valve housing 158 is not pressurized to a sufficient level to tightly hold the poppet 154 against its seat 152. The vent valve assembly 150 is connected to the supply tube 112 of the pressure vessel 110. An ultra-high pressure pump 162 with a water inlet 164 is also coupled to the vent valve assembly.

Figure 1B:
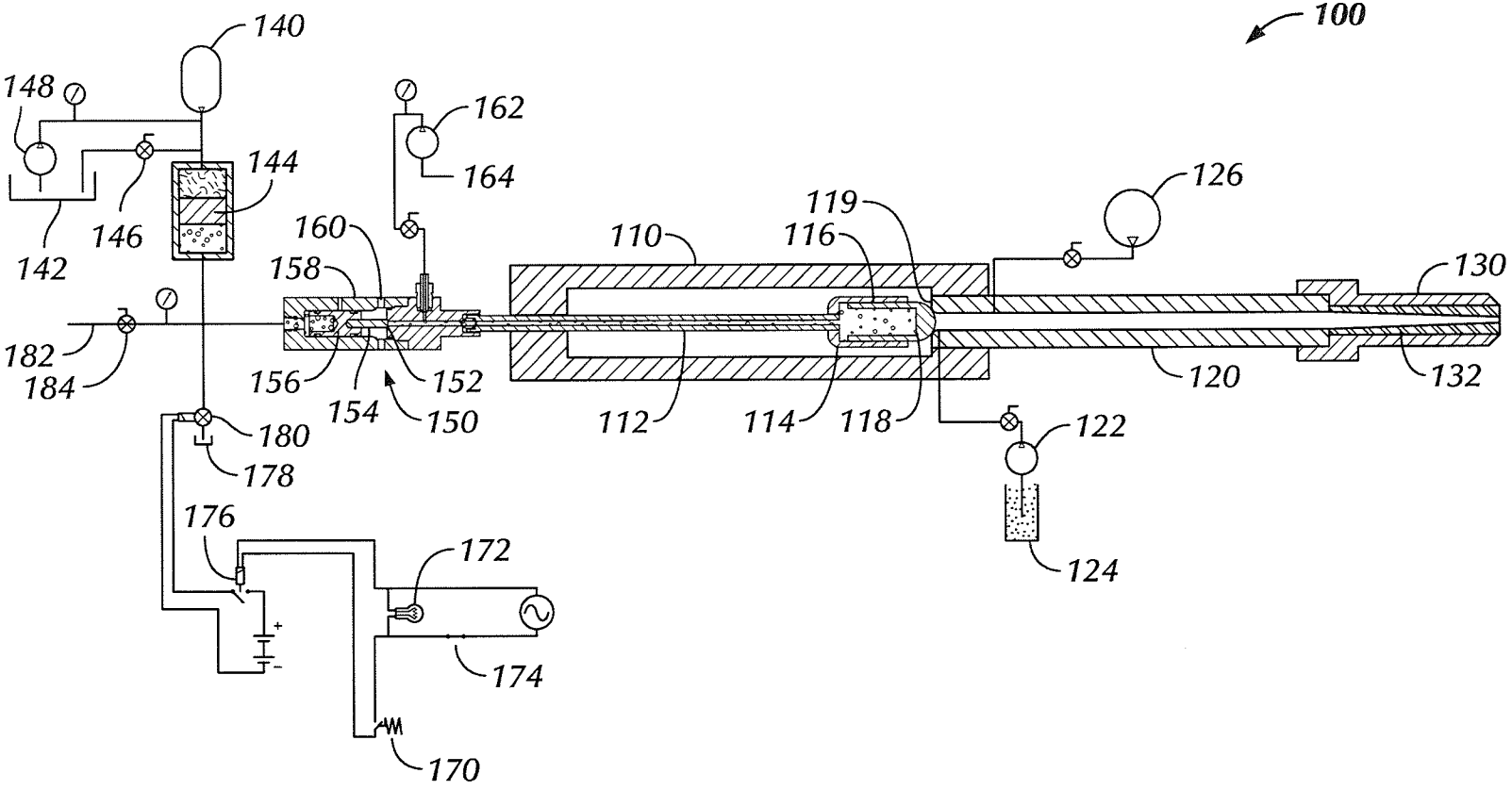
FIGS. 1B-1E illustrate the hyper-pressure pulse excavator 100 in various stages of preparing to fire a water pulse.

FIG. 1B shows the system ready to fire a water, or water-based, pulse. The pressurized water supply valve 184 is closed. The hydraulic pump return valve 146 of the hydraulic pump 148 is closed, and the hydraulic pump 148 has been actuated, pressurizing the top of the isolator piston 144 with oil, water, or another fluid. The other side of the isolator piston 144 contains water. When the top of the isolator piston 144 is pressurized, the left side of the vent valve piston 156 is pressurized, causing the vent valve piston 156 to push against and hold the vent valve poppet 154 against the vent valve poppet seat 152. The ultra-high pressure pump 162 is then actuated and used to charge the pressure vessel 110 through the supply tube 112 into the cavity between the poppet sleeve 114 and poppet 118 within the pressure vessel 110. This pressurization pushes the poppet 118 against its seat 119 at the outlet of the pressure vessel 110, closing the fluid path to the straight nozzle section 120. With the poppet 118 seated against the straight nozzle section 120, the sleeve port 116 is exposed, allowing water to flow into the pressure vessel 110 through the supply tube 112. As more water is pumped into the pressure vessel 110, the pressure within the pressure vessel 110 builds, typically to 100 to 400 MPa.

In parallel, the air compressor 126 may supply compressed air to the straight nozzle section 120. This helps to empty the straight nozzle section 120 and tapered nozzle section 132 of any residual water (for example, from the previous water pulse firing). In one embodiment, a small volume of a gelled fluid 125 such as agar, polyacrylamide, or bentonite gel may be metered using the metering pump 122 from into the straight nozzle section 120 immediately below the poppet seat 119. This precharges the straight nozzle section 120 with the gelled fluid 125, allowing the gelled fluid 125 to be on the leading edge of the fluid pulse when the pulse excavator 100 fires. This gelled fluid may also be weighted with a substance such as salt to increase its density. The arm switch 174 electrical circuit is then armed, the air valve of the air compressor 126 is closed, and the system 100 is ready to fire.

Figure 1C:
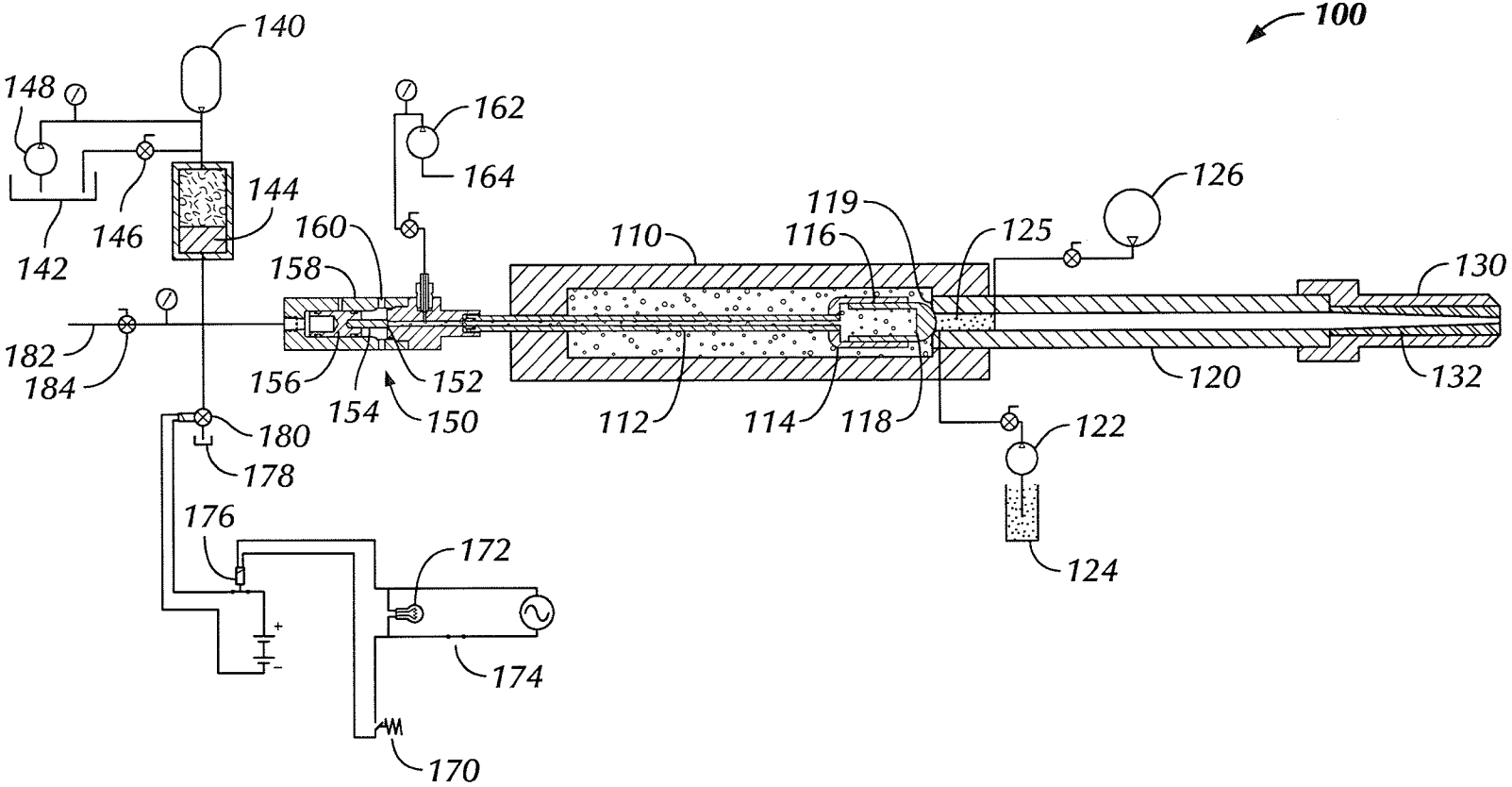

FIG. 1C illustrates the start of the firing sequence. The push button switch 170 is closed or depressed, causing the relay switch 176 to close and the solenoid valve 180 to open. As the solenoid valve 180 opens, the isolator piston 144 moves down at constant pressure. The opening time of the solenoid valve 180 is preferably very short, such as on the order of 100 milliseconds so, but there is a limit to the opening speed of solenoid valves. The isolator piston 144 and accumulator 140 assembly give the solenoid valve 180 time to open fully by maintaining pressure on the vent valve poppet 154 before the isolator piston 144 reaches the end of its travel. As soon as the isolator piston 144 reaches the end of its travel, the left side of the vent valve piston 156 is depressurized, and the ultra-high pressure on the face of the vent valve poppet 154 causes it to open.

Figure 1D:
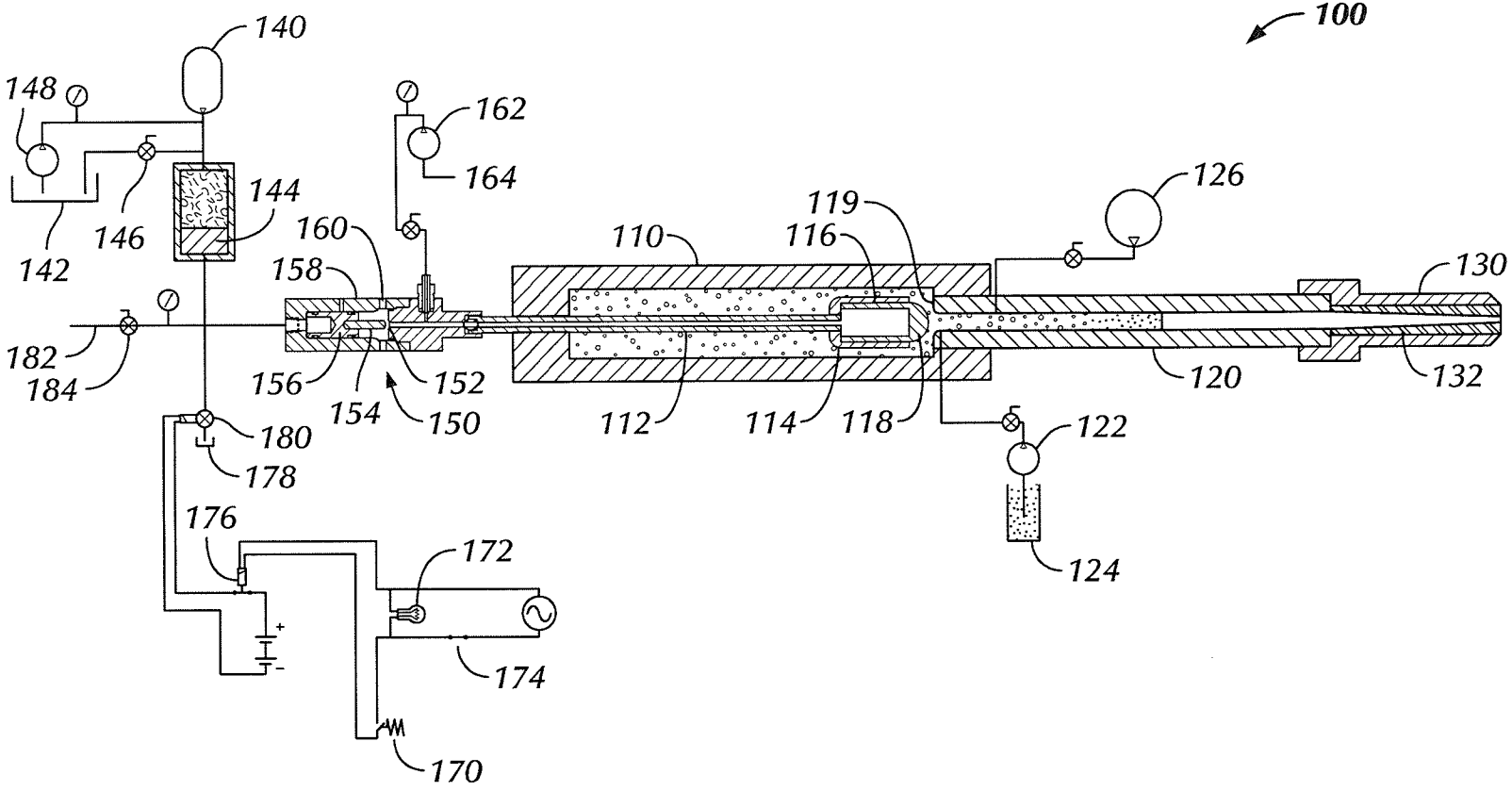
Figure 1E:
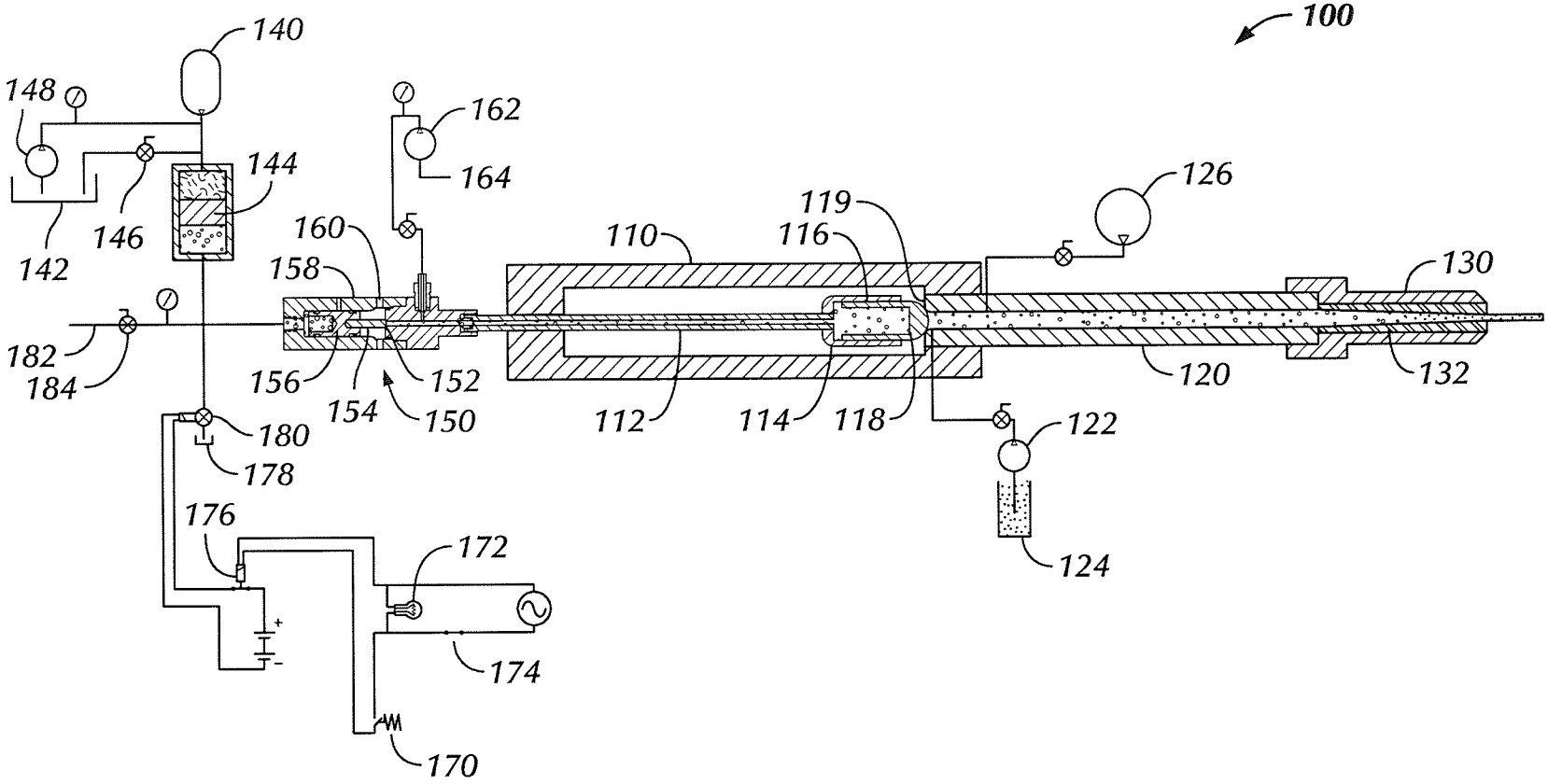

FIG. 1D illustrates the continuation of the firing sequence, with the vent valve poppet 154 fully open. This depressurizes the water in the supply tube 112 and the volume of water in the cavity between the poppet 118 and poppet sleeve 114 in the pressure vessel 110. Because the section area of the poppet 118 is larger than the seal area of the poppet seat at the base of the straight nozzle section 120, a large force lifts the poppet 114 from its seat. The poppet 118 opens very quickly, acting like a fast-opening dump valve and discharging the compressed water from the body of the pressure vessel 110. Once the poppet 118 is open, the water contained in the pressure vessel 110 begins accelerating through the straight nozzle section 120. As mentioned above, if gel has been metered out into the straight nozzle section 120, the gel slug is also pushed by the accelerating water pulse. The gel slug and water slug are pushed through the straight nozzle section 120 as well as the nozzle housing 130, as shown in FIG. 1E. The nozzle housing 130 contains a tapered nozzle section 132, which tapers from the diameter of the opening of the straight nozzle section 120.

Figure 4:
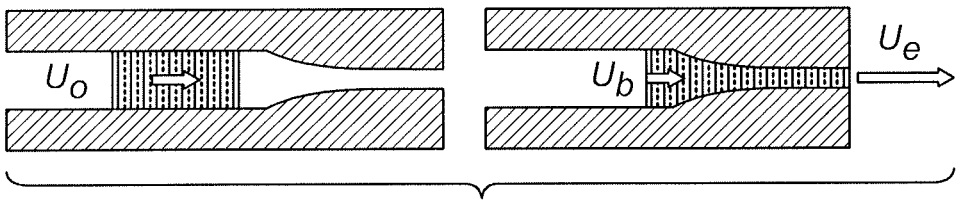
FIG. 4 illustrates the process of unsteady flow acceleration of a water pulse through straight and tapered nozzle sections.

Due to the unsteady flow phenomenon, the gel and water slugs are extruded though the tapered nozzle section 132 at extremely high velocities. The process of unsteady flow acceleration is illustrated in FIG. 4. When a fluid pulse moving at uniform velocity, $U_o$, enters a tapered nozzle, the leading edge of the pulse accelerates ($U_e$), while the trailing edge of the pulse slows ($U_b$). The velocities can be calculated for a given nozzle profile based on the principles of continuity of momentum and volume. If no gel is used, then the water will be at the leading edge of the pulse. In a preferred embodiment of the invention, the tapered section 132 is exponential.

Due to the extreme pressures generated in employing this technique, nozzle wear and fatigue of the cannon body are concern for long-term operation. The tapered nozzle section 132 is preferably fabricated from a hard erosion-resistant material such as hardened steel or carbide. This material may be held by a nozzle housing 130 made of high strength steel. The two part construction of the tapered nozzle allows the use of hard, erosion-resistant materials that may have low tensile strength. Conversely, the tapered nozzle can be fabricated from one part if a sufficiently high strength steel is used.

Figure 2A:
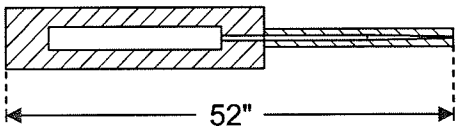
FIGS. 2A-2C illustrate exemplary measurements for various sizes of the hyper-pressure pulse excavator 100.
Figure 2B:
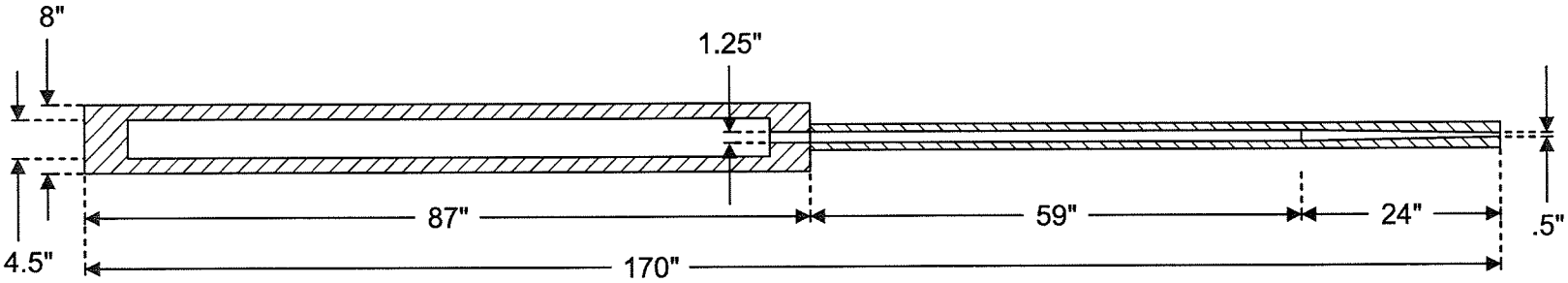
Figure 2C:
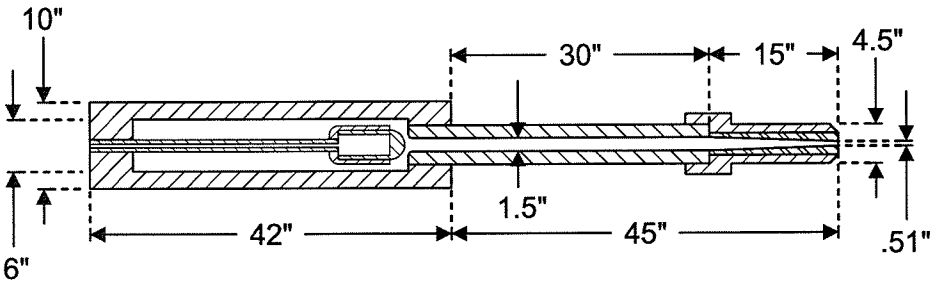

FIGS. 2A-2C illustrate exemplary dimensional measurements for various sizes of the hyper-pressure pulse excavator 100. The productivity of hyper-pressure pulse excavation can be expressed in terms of specific energy, which is the ratio of the pulse energy to the volume of rock removed. Increasing the scale of the system increases efficiency substantially, since the specific energy required for breaking is inversely proportional to the rock fragment size. As described above, impact piston cannons provide a means of generating hyper-pressure pulses, but the mechanism for these devices is very bulky and generates large reaction forces. Further, as also described above, their use in commercial excavation work has been limited due to the significant wear on the pistons and cylinders of the devices. The compressed water cannon as described herein can provide the similar pressure levels more efficiently. As described above, the pulse excavator 100 uses the system of cascaded valves to build to sufficient pressure levels. In a smaller embodiment, such as the one seen in FIG. 2A, alternate valve systems, such as a hand valve or a large solenoid valve, may be used. This may allow the pulse excavator 110 to be operated with a single- or dual-level valve system. For larger embodiments, such as the ones seen in FIGS. 2B and 2C, single- or dual-level valve systems will likely not provide the performance required for operation. Additionally, the cascaded valve system allows for smaller valves to be used at the various stages, further allowing for the use of smaller batteries to actuate the solenoid valve 180.

The specifications for the exemplary embodiment shown in FIG. 2A of the compressed water cannon for use in hyper-pressure pulse excavation are as follows:

1.8-liter internal volume;

15 kJ @ 240-MPa charge pressure; and 12.7-mm-diameter discharge nozzle.

The operating pressure of the pressure vessel 110 alone is limited by practical considerations to 100-400 MPa (14,500-60,000 psi). However, the pressure required to effectively break harder rock requires fluid pulses with stagnation pressures above 2 GPa (300,000 psi). As mentioned above, the straight nozzle section 120 and tapered nozzle section 132 are used to amplify the velocities of fluid pulses to achieve the stagnation pressures required to effectively break rock. The diameter of the straight nozzle section 120 may be equal to the diameter of the discharge valve of the pressure vessel 110. The diameter of the straight nozzle section 120 is smaller than the diameter of the pressure vessel 110 bore—typically, around 20% to 30% of the bore is preferred, though the range could be 10% to 50%.

Figure 3A:
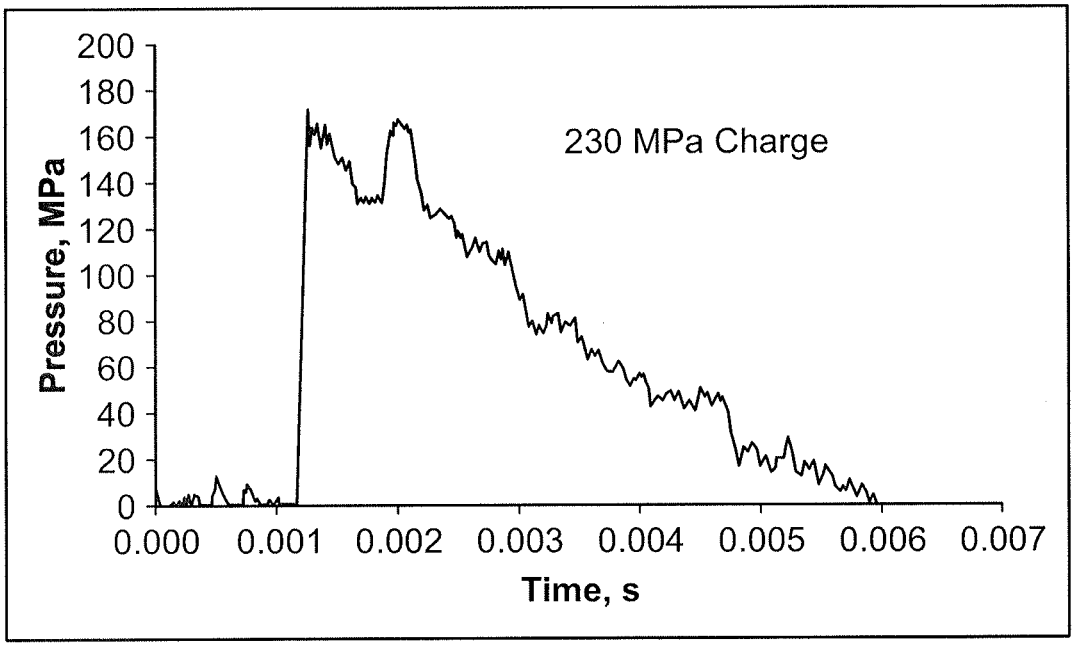
FIGS. 3A-3C show nozzle inlet pulse measurement charts based on a 230 MPa discharge from the exemplary embodiment shown in FIG. 2A.
Figure 3B:
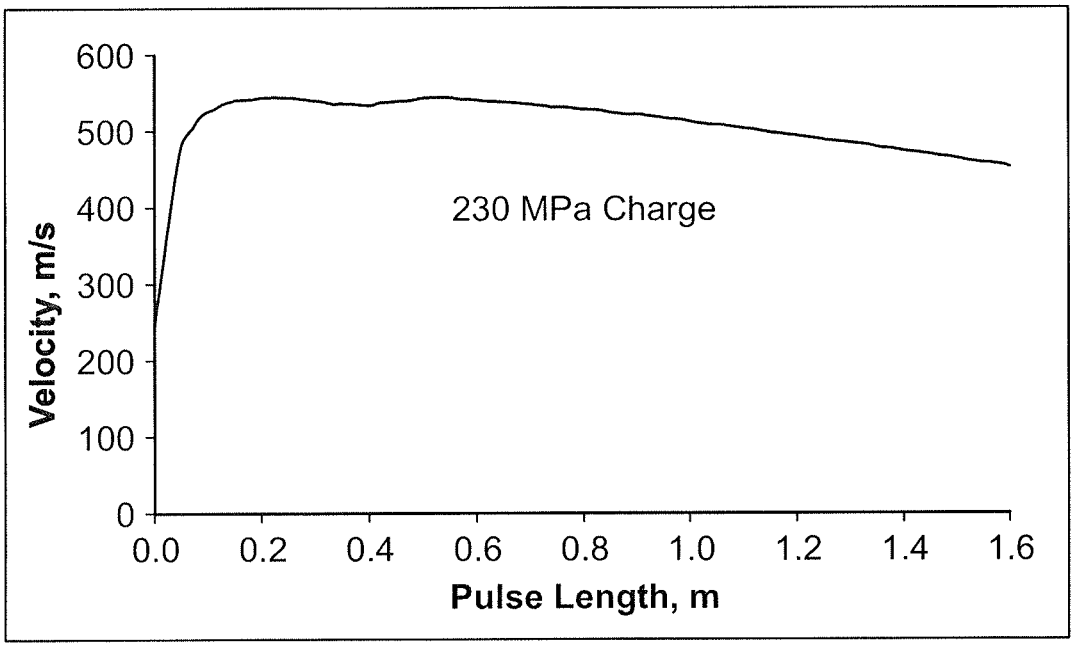
Figure 3C:
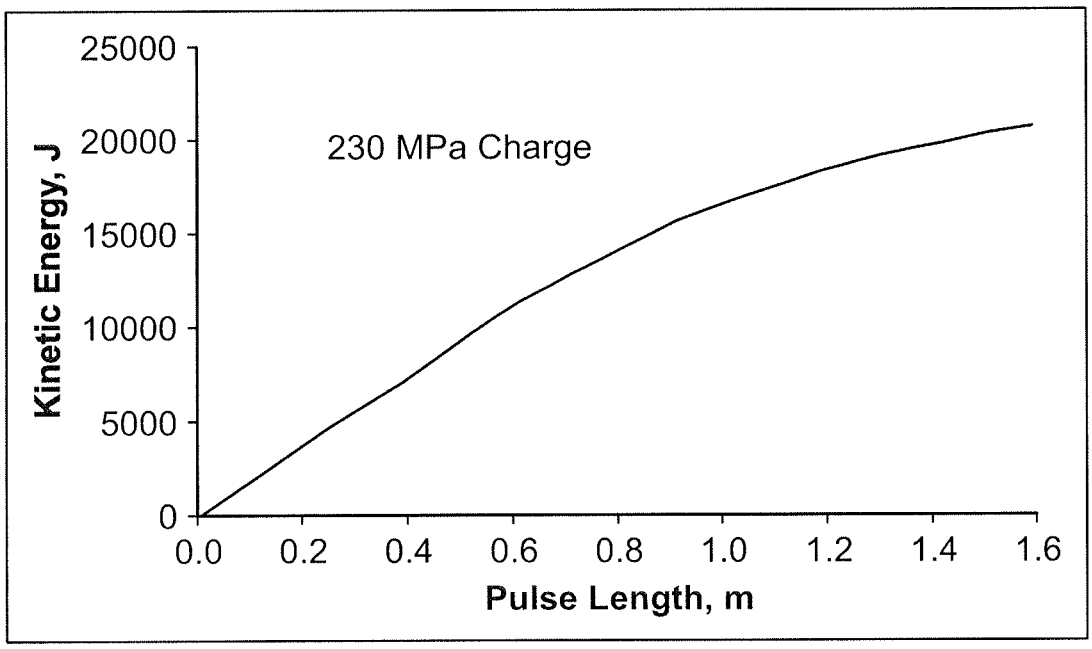

The length of the straight nozzle section 120 is determined by observing the discharge characteristics of the pressure vessel 110 without the nozzle section attached. FIG. 3A shows the observed stagnation pressure from a water pulse discharged from the exemplary embodiment shown in FIG. 2A (without the attached nozzle) when the pressure vessel 110 is charged to 230 MPa versus time. Note that the peak stagnation pressure is substantially less than the charge pressure of 230 MPa. Further, the rise time of the pressure release is very fast, on the order of 1-2 ms. The fast rise time is facilitated by the presence of the fast-opening dump valve, such as the poppet valve 118. FIG. 3B shows the velocity of the pulse as a function of pulse length as calculated from the stagnation pressure profile. A uniform-velocity slug of water is needed to generate a hyper-pressure pulse in a tapered nozzle section 132. In practice, the velocity of water exiting the cannon valve varies continuously, however a pulse of about 0.5 m length with a velocity of over 500 m/s is generated. The kinetic energy of the pulse rises linearly up to around 0.5 m and then increases at a lower rate. The velocity is slow as the valve opens, peaks after the valve is opened, and then drops as the cannon decompresses. A straight nozzle section 120 accumulates the water in the leading edge of the pulse and allows the higher-velocity fluid to catch up, forming a uniform-velocity slug. Once the slug velocity starts to drop, the slug will stretch and break up.

Based on a measurement of the discharge pressure of the pressure vessel 110 at 230 MPa, the velocity of the water pulse can be measured against the length of the pulse. To reach efficiencies, pulse velocity and length should be maximized. For the pressure vessel 110 of the exemplary embodiment shown in FIG. 2A, a pulse length of 0.5 meters was chosen based on the chart shown in FIG. 3B. The point representing the pulse length of 0.5 meters in FIG. 3B was selected as maximizing both pulse velocity and length because the pulse velocity begins to decrease more substantially after the pulse length of 0.5 meters. Accordingly, the length of the straight nozzle section 120 was set at 0.5 meters. The final volume of the straight nozzle section 120 may be preferably between 2-10% of the volume of the pressure vessel 110.

Given a 20 inch long (i.e., roughly 0.5 meter) slug with a diameter of 0.5 inch, the tapered nozzle parameters may be determined. As mentioned above, the tapered nozzle section 132 accelerates the leading edge of the pulse to hyper velocity through unsteady flow dynamics. Given a convergent tapered nozzle 132 with an arbitrary profile, it is possible to calculate the velocity of the slug of water everywhere as the slug is extruded though the taper by solving the equations for continuity of volume and momentum. This may be determined using a numerical simulation of these continuity equations for various nozzle profiles. The internal pressure along the length of the nozzle can also be calculated from the local acceleration. The details of this calculation are described in Glenn, Lewis A. (1974) "On the dynamics of Hypervelocity liquid jet impact on a flat rigid surface," *Journal of Applied Mathematics and Physics* (*ZAMP*), vol. 25.

Figure 5A:
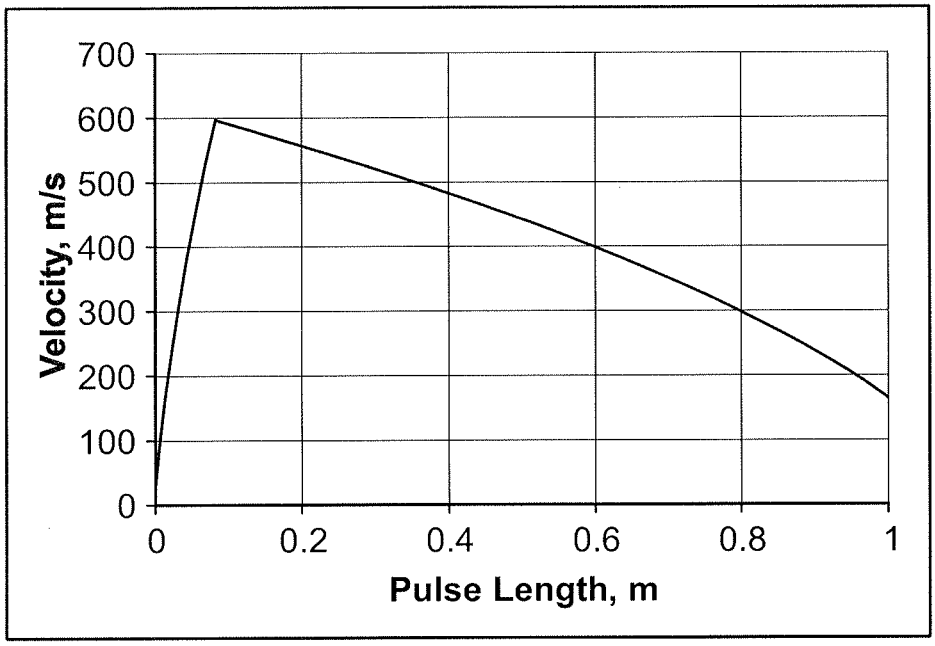
FIG. 5A-5C illustrate the hyper-pressure outlet pulse measurement charts.
Figure 5B:
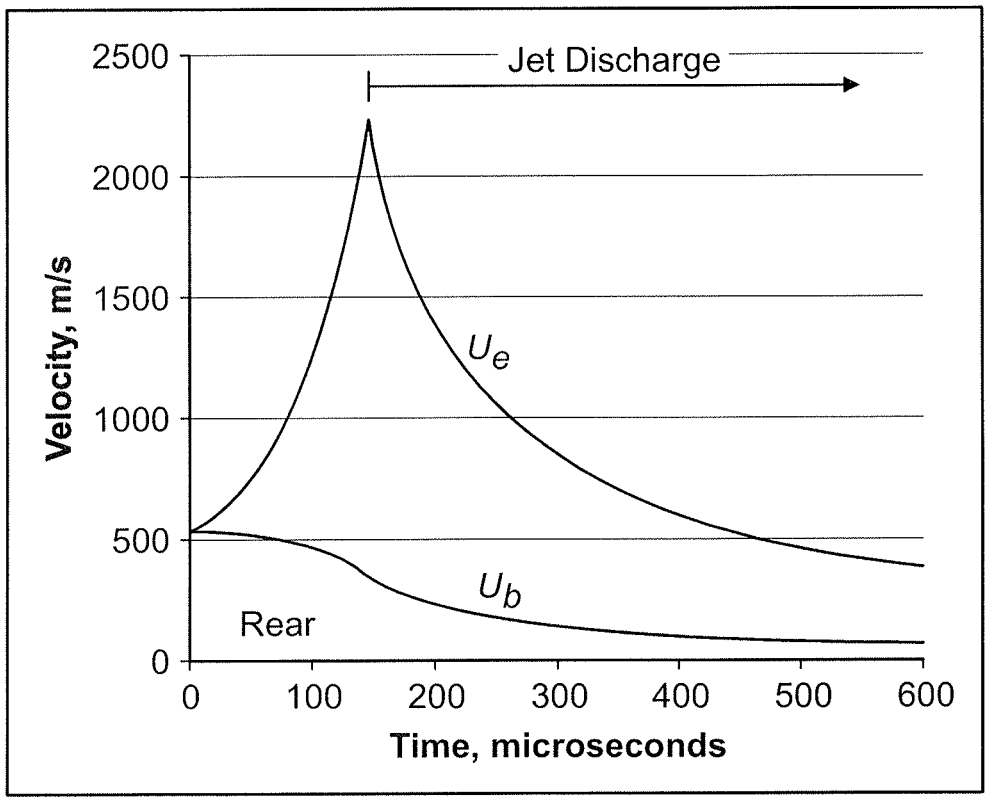
Figure 5C:
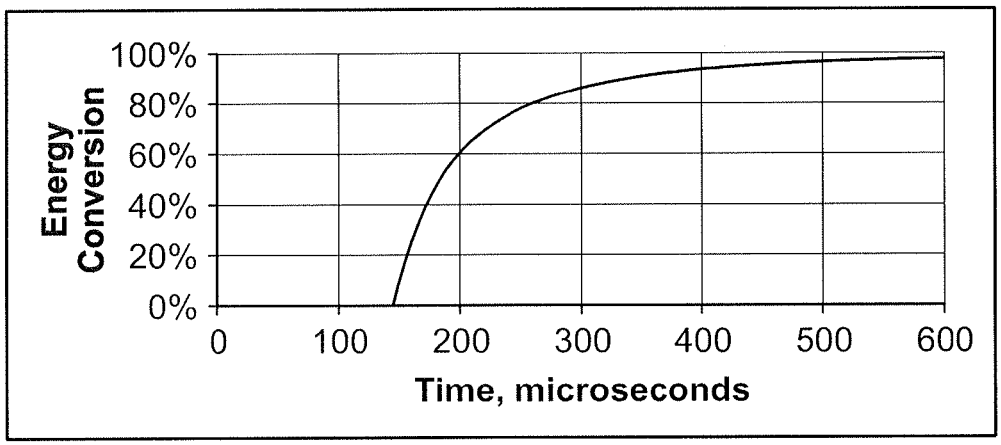

A numerical analysis indicates that the exemplary compressed water cannon tool from FIG. 2A can produce a compressed water pulse that is 300-mm in length, traveling at a velocity of about 520 m/s, as shown FIG. 5A. The theoretical profile agrees reasonably well with the observed profile shown in FIG. 3B. The theoretical velocities of the leading and trailing edges (shown as $U_e$ and $U_b$, respectively) of this water slug as it moves through the tapered nozzle are shown in FIG. 5B. The leading edge accelerates to over 2000 m/s, while the trailing edge decelerates. The peak velocity drops rapidly, to under 1000 m/s after 200 μsec. In this time the leading edge of the pulse will travel 0.4 m (16 in.). The nozzle should be located at a fraction of this distance from the target to maximize effectiveness. The velocity profiles may be calculated by assuming that the water is an incompressible fluid, although water is compressible at such velocities. The peak velocity of the discharged jet may be limited by the speed of sound in water (around 1500 m/s), which may limit the peak velocities to values lower than those shown in FIG. 5B. The compressed water pulse will convert to a 2-GPa pressure spike in a 150-mm-long convergent tapered nozzle, as shown in FIG. 5B, with 80% energy conversion above 1 GPa, as shown in FIG. 5C.

Figure 5D:
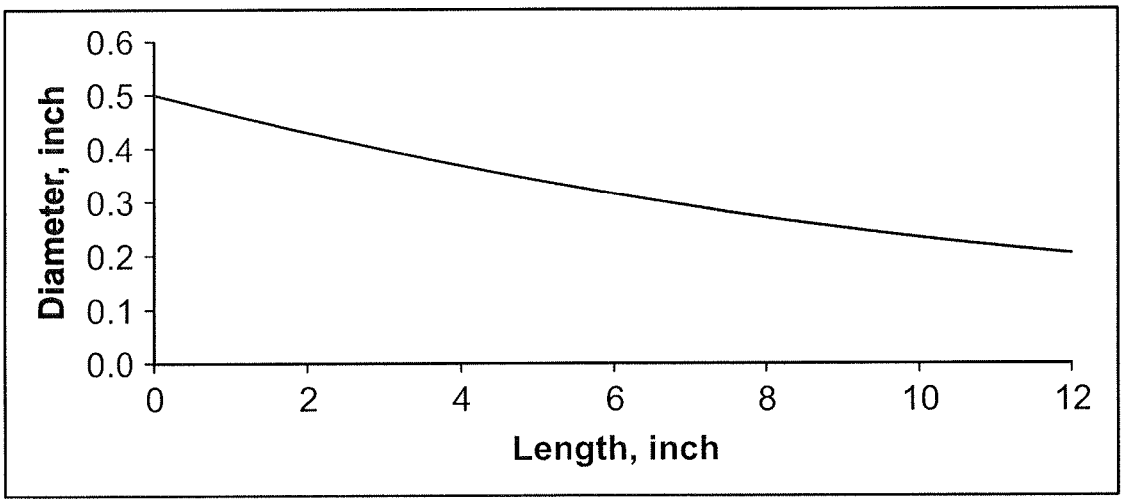
FIG. 5D shows a chart displaying an exemplary exponentially convergent tapered nozzle profile.
Figure 5E:
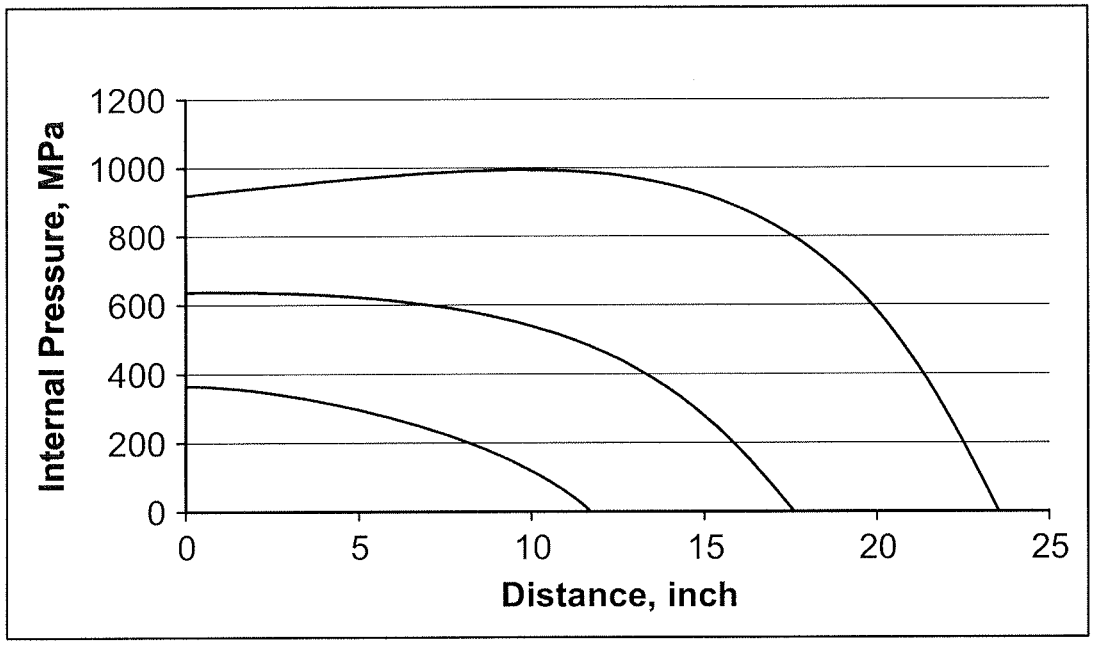
FIG. 5E shows a chart displaying the internal pressure profiles inside an exponentially tapered nozzle at three locations of the fluid pulse.

An example of the internal pressure profiles inside an exponentially tapered nozzle at three locations of the pulse is provided in FIG. 5E. The internal pressure builds as the pulse enters the tapered section. The peak pressure occurs at the moment that the pulse reaches the exit of the nozzle. The peak internal pressure is less than 1 GPa (145,000 psi) which is within the capacity of the nozzle materials available. In a preferred embodiment of the invention, the nozzle comprises a carbide inner section that is pressed into a sleeve to provide a preload on the carbide. Those skilled in the art will understand that a composite nozzle of this type provides higher internal pressure capacity than a monobloc nozzle.

The cross-sectional area of the tapered nozzle section 132 is denoted as A(x), and it decreases exponentially along the length of the tapered nozzle section 132, which is denoted as x. The relationship between the length and cross-sectional area of the tapered nozzle section 132 is shown according to the following exponential equation:

$$A(x) = A_i \exp\left(\frac{-x\ln(R)}{l_t}\right)$$

In this equation, R is the inlet/outlet area ratio; and $l_t$ is the total length of the tapered nozzle section 132. An example of a nozzle profile is as shown in FIG. 5D, which is derived from the data in the following Table 1.

| | Length, in. | Diameter, in. |
|---|---|---|
| Straight | 20 | 0.500 |
| Taper | 0 | 0.500 |
| | 2 | 0.429 |
| | 4 | 0.369 |
| | 6 | 0.316 |
| | 8 | 0.272 |
| | 10 | 0.233 |
| | 12 | 0.200 |

An exponential tapering is used for the tapered nozzle section 132, as opposed to a linear tapering, to prevent the tapered section from being blown off from the pressure release during a firing. An external nut may be used to clamp the tapered nozzle section 132 to the straight nozzle section 120. This nut may be attached with a torque of about 2000 ft-lbf. Based on the configuration of the straight nozzle section 120 and tapered nozzle section 132, a water cannon may be converted into the hyper-pressure water cannon 100 suitable for use in excavation applications.

Although the concepts disclosed herein have been described in connection with the preferred form of practicing them and modifications thereto, those of ordinary skill in the art will understand that many other modifications can be made thereto. Accordingly, it is not intended that the scope of these concepts in any way be limited by the above description.

The invention claimed is:

1. A hyper-pressure water cannon system for producing a fluid pulse comprising:

a pressure vessel configured to couple to a source of pressurized fluid, the pressure vessel comprising a dump valve; and a nozzle comprising a straight section and a convergent tapered section, the nozzle coupled to the pressure vessel after the dump valve, wherein pressurized fluid discharged from the pressure vessel by the dump valve increases in velocity as it travels through the nozzle, wherein the internal volume of the straight section is between 2% to 10% of the internal volume of the pressure vessel.

2. The hyper-pressure water cannon of claim 1, wherein the fluid pulse comprises water.

3. The hyper-pressure water cannon of claim 1, wherein the fluid pulse comprises water with additives.

4. The hyper-pressure water cannon of claim 3, wherein the additives comprise salt or polymer.

5. The hyper-pressure water cannon of claim 1, further comprising:

a compressor coupled to the base of the nozzle, wherein the compressor discharges air into the nozzle after the pressurized fluid travels through the nozzle.

6. The hyper-pressure water cannon of claim 1, further comprising:

a metering pump coupled to the base of the nozzle, wherein the metering pump discharges a metered supply of gelled fluid into the nozzle.

7. The hyper-pressure water cannon of claim 1, wherein the pressurized fluid in the pressure vessel is charged to a pressure between 100 MPa to 400 MPa.

8. The hyper-pressure water cannon of claim 1, wherein the diameter of the straight section is equal to the inlet diameter of the convergent tapered section.

9. The hyper-pressure water cannon of claim 1, wherein the length of the convergent tapered section is 30% to 200% of the length of the straight section.

10. The hyper-pressure water cannon of claim 1, wherein the outlet diameter of the convergent tapered section is 10% to 50% of the diameter of the inlet diameter of the convergent tapered section.

11. The hyper-pressure water cannon of claim 1, wherein the diameter of a taper profile of the convergent tapered section decreases exponentially across the length of the convergent tapered section.

12. The hyper-pressure water cannon of claim 1, wherein the diameter of a taper profile is modeled based on a series of linear approximations to an exponential equation with an asymptote at the outlet of the convergent tapered section.

13. The hyper-pressure water cannon of claim 1, wherein the dump valve is a piloted poppet valve.

14. The hyper-pressure water cannon of claim 13, wherein the piloted poppet valve is opened through a series of cascading valves by a solenoid valve.

15. The hyper-pressure water cannon of claim 14, wherein the piloted poppet valve is coupled to an accumulator.

16. A method of producing a fluid jet pulse with discharge velocity of 1 to 2 km/s, comprising:

charging a pressure vessel to 100 to 400 MPa with a water-based fluid;

releasing the water-based fluid though a discharge passage with a dump valve;

directing the flow of the water-based fluid into an elongated straight nozzle section; and directing the flow of the water-based fluid into an elongated convergent tapered section, wherein the internal volume of the straight nozzle section is between 2% to 10% of the internal volume of the pressure vessel.

17. The method of claim 16, further comprising:

purging the elongated straight nozzle section and the elongated convergent tapered nozzle section by introducing compressed air at the inlet of the elongated straight nozzle section.

18. The method of claim 16, further comprising:

precharging the elongated straight nozzle section with a gelled fluid.

19. The method of claim 16, further comprising:

excavating a rock surface by directing the water-based fluid at the rock surface.

20. The method of claim 19 wherein the nozzle exit is located at a range of zero to ten times the diameter of the nozzle exit from the rock face.

21. The method of claim 16, wherein the dump valve is opened within 20 ms.

22. The method of claim 16, wherein the dump valve is opened through a series of cascading valves by a solenoid valve.

23. The hyper-pressure water cannon of claim 11, wherein the cross-sectional area of the taper profile is derived from the equation:

$$A(x) = A_i \exp\left(\frac{-x\ln(R)}{l_t}\right),$$

wherein A(x) is the area of the cross section of the taper profile at a given length x, wherein $l_t$ is the total length of the convergent tapered section of the nozzle, wherein R is the ratio of the inlet area of the convergent tapered section to the outlet area of the convergent tapered section.

24. The hyper-pressure water cannon of claim 1, wherein the straight section has a length substantially similar to the length of a fluid pulse of pressurized fluid discharged from the pressure vessel absent the nozzle.

* * * * *